US008151980B2

(12) United States Patent
DeMartino

(10) Patent No.: US 8,151,980 B2
(45) Date of Patent: Apr. 10, 2012

(54) JEWELRY HOLDER AND ORGANIZER

(76) Inventor: Susan DeMartino, Boca Raton, FL (US)

( * ) Notice: Subject to any disclaimer, the term of this patent is extended or adjusted under 35 U.S.C. 154(b) by 0 days.

(21) Appl. No.: 12/804,157

(22) Filed: Jul. 14, 2010

(65) Prior Publication Data

US 2011/0011753 A1 Jan. 20, 2011

Related U.S. Application Data

(60) Provisional application No. 61/270,965, filed on Jul. 14, 2009.

(51) Int. Cl.

| | |
|---|---|
| ***A45C 11/04*** | (2006.01) |
| ***B65D 73/00*** | (2006.01) |
| ***B65D 25/24*** | (2006.01) |
| ***A47F 7/02*** | (2006.01) |
| ***A47F 5/08*** | (2006.01) |

(52) U.S. Cl. ..... 206/6.1; 206/495; 211/85.2; 220/476; 220/483; 312/245

(58) Field of Classification Search ..... 206/6.1, 206/495, 566; 211/85.2; 220/476–483; 312/245
See application file for complete search history.

(56) References Cited

U.S. PATENT DOCUMENTS

| | | | | |
|---|---|---|---|---|
| 4,573,585 | A * | 3/1986 | Frei | 211/85.2 |
| 4,606,458 | A * | 8/1986 | LaBate | 206/566 |
| 5,316,178 | A * | 5/1994 | Garber, Jr. | 220/481 |
| 5,950,815 | A * | 9/1999 | Yetman-Bellows | 206/6.1 |
| 7,008,029 | B1 * | 3/2006 | Aclin | 312/245 |
| 7,389,868 | B2 * | 6/2008 | Lewand et al. | 206/6.1 |
| 7,806,255 | B1 * | 10/2010 | Staver | 206/6.1 |
| 2003/0234185 | A1 * | 12/2003 | Flagg | 206/6.1 |
| 2006/0180481 | A1 * | 8/2006 | McGaughey, Sr. | 206/6.1 |
| 2008/0060951 | A1 * | 3/2008 | Pantelis et al. | 206/6.1 |

* cited by examiner

*Primary Examiner* — Bryon Gehman
(74) *Attorney, Agent, or Firm* — Robert M. Downey, P.A.

(57) ABSTRACT

A jewelry holding apparatus is adapted for attachment to a flat surface, and particularly the inner surface of a medicine cabinet door in the interest of convenience, privacy and space efficiency. The apparatus has a two-part frame which clips together to suspend a mesh screen for storing a variety of hook-type or loop earrings, as well as accessory hooks. The apparatus further includes an arrangement of adjacently positioned foam pillows that are packed tightly together for holding various items of jewelry between the foam pillows. An arrangement of hooks on the frame allow for storage of bracelets, watches, small necklaces, rings and earrings. One or more posts on either side of the top of the frame allow for hanging of longer necklaces. The apparatus mounts to the inner side of a medicine cabinet door using built-in magnets or adhesive pads.

3 Claims, 4 Drawing Sheets

10
34
30

34
30
20
10
24
34

5
34
28
54
21
12
34
5
18
32
30
34
28
54
23
10
34

JEWELRY HOLDER AND ORGANIZER

This patent application is based on provisional patent application Ser. No. 61/270,965 filed on Jul. 14, 2009.

BACKGROUND OF THE INVENTION

1. Field of the Invention

The present invention generally relates to jewelry storage devices, and more specifically to wall or door mounted devices for storing and displaying multiple types of jewelry in a low profile, easily visible and organized manner.

2. Discussion of the Related Art

Jewelry has been traditionally stored in jewelry boxes, chest drawers, or simply mixed together on top of a furniture surface or vanity. Storing one's jewelry collection in an organized manner that allows for easy viewing and access to each item can be a challenge. Particularly the storage of jewelry items such as earrings and necklaces can result in an unsightly tangled mess which can make it difficult to organize and find corresponding matching earrings when getting dressed. Accordingly, there remains a need for a jewelry storage device which can be hidden out of sight, located in a convenient place, able to store jewelry in an orderly manner, and able to store all types of jewelry.

U.S. Pat. No. 4,767,011 to Butler (1988) describes an enclosed frame supporting a mesh for attaching earrings. Butler aims to correct flaws in previous earring storage design by employing the mesh screen. The present invention expresses several distinct improvements over Butler's design, most importantly the ability to store many types of jewelry besides earrings alone. In addition, built in magnets or adhesive pads allow for easy attachment to the inner side of a medicine cabinet door for both convenience and privacy. Finally, the storage of rod and fastener type earrings is significantly easier with the design of the present invention because as opposed to having to remove and then attach the fastener each time the earring is stored or removed from the device, as is the case with the Butler earring storage device. According to the present invention, a post earring is simply placed between two foam pads without having to remove the fasteners from the earring post.

U.S. Pat. No. 5,050,745 to Sanders (1991) describes a frame mounting a screen for the storage of pierced earrings and a loop-like leash supporting the frame onto which clip-on earrings may be stored. The leash also serves as a manner for hanging up the apparatus on a hook. Sanders does not accommodate for types of jewelry besides earrings. In addition, Sanders doesn't allow for any manner of storing the apparatus except by hanging it, which may not always be an option. The present invention accommodates all types of earrings including clip-on earrings (which may be clipped onto the hooks in the present invention, placed between the foam pads or placed on a hook accessory) post and fastener earrings, and loop earrings, in addition to all other types of jewelry, while allowing for more convenient storage.

U.S. Pat. No. 5,261,529 to Holland (1993) describes an earring storage apparatus consisting of multiple vertical panels having mesh-like screens which hang from retaining rods braced over the sides of an open container. Holland allows for easy categorization through the use of multiple panels and for space efficient storage through use of a box container. A second embodiment involves hanging multiple earring panels from a wall mounted swivel bracket, allowing for easier access than the first embodiment. Holland does not accommodate any type of jewelry besides earrings, and requires that rod and fastener type earrings be released and secured for each storing. The first embodiment suffers from low visualization, requiring the user to pull out multiple panels if they have not committed the locations of all of their earrings to memory. The second embodiment is particularly inconvenient because of the setup required for the wall mounted swivel bracket, which involves the use of nails and damaging a wall. Also, the second embodiment leaves several panels protruding into the open space next to the wall. The present invention improves upon the features of Holland by allowing for storage of all jewelry types including but not limited to earrings and by storing in a visible, organized manner without use of a box or nails driven into a wall.

U.S. Pat. No. 5,363,953 to Carter (1994) illustrates a flexible screen or mesh for receiving the shaft or hook-like structures of jewelry items. Carter's device is enclosed in a flexible fabric frame which allows it to be rolled into a cylindrical configuration for easy transportation. Fastening devices are attached which allow the device to be easily maintained in rolled configuration and which allow the device to attach for display or storage. Carter discloses an invention which is particularly well suited for travelling. For household use however, Carter fails to provide storage for jewelry besides earrings with shafts or hooks. In addition, the nature of the attachment is such that it will need to be attached to a wall or flat surface, which would make retrieving the fasteners from rod and fastener type earrings particularly inconvenient. The present invention allows for easier storage of rod and fastener type earrings, storage for more types of jewelry besides earrings, and a more convenient easy to access type of attachment for display.

U.S. Pat. No. 7,008,029 to Aclin discloses a wall suspendible cabinet for storing and displaying jewelry items, especially of the type for storing and displaying earrings having a looped hook or a post and lock fastener. Aclin does not, however, provide a means for storing other types of jewelry besides earrings of the hook or post and fastener type. Also, Aclin requires wall mounting which is inconvenient and requires a large amount of space. Aclin aims to provide a cabinet which has a mirror or picture on the exterior with the storage space on the interior. The present invention allows for storage of jewelry to be added to any previously existing medicine cabinet which would therefore combine the mirror, jewelry storage and medicine/accessory storage into one unit. The present invention also allows for the storage of all types of jewelry as opposed to earrings alone.

Notwithstanding the teachings in the related art, there remains a need for a jewelry storage device and organizer which is particularly adapted for storing all types of jewelry in a visually pleasing, organized and space efficient manner, and wherein the device is structured for low profile mounting on the back side of a medicine cabinet door.

Objects and Advantages of the Invention

Considering the foregoing, it is a primary object of the present invention to provide a simple jewelry holder and organizer device which is easily installed on a flat surface such as the interior of a medicine cabinet door to provide an orderly and conveniently accessible place for storing one's jewelry.

It is a further object of the present invention to provide a simple jewelry storing device, as detailed above, which is attached to a flat surface through the use of built in magnets or adhesive pads for easy attachment and removal.

It is still a further object of the present invention to provide a simple jewelry storing device, as detailed above, which is capable of storing hook-type jewelry and storage hooks through the use of a mesh screen which is pulled tight.

It is still a further object of the present invention to provide a simple jewelry storing device, as detailed above, which is capable of storing rings, rod and fastener type earring and clip-on earrings through the use of tightly packed foam pads between which jewelry can be inserted for convenient storage and aesthetically pleasing display.

It is still a further object of the present invention to provide a simple jewelry storing device, as detailed above, which is capable of storing short necklaces, bracelets, watches, rings and earrings and other such jewelry through the use of several hooks at the bottom of the device.

It is still a further object of the present invention to provide a simple jewelry storing device, as detailed above, which is capable of storing long necklaces and other long types of jewelry through the use of several posts at the top of the device.

It is still a further object of the present invention to provide a simple jewelry storing device, as detailed above, which is easy to manufacture, package and distribute.

These and other objects and advantages of the present invention are more readily apparent with reference to the detailed description and accompanying drawings.

SUMMARY OF THE INVENTION

The present invention is directed to a jewelry storing device which is capable of being easily installed on a flat surface with the use of built-in magnets for metallic or magnetically attractive surfaces or with the use of adhesive pads (double-sided adhesive tape) for non-metallic surfaces. In one embodiment, the magnets are adhered to the device within preformed pockets located in the corners of the back face of the frame. Of these surfaces, most notable is the inner surface of a medicine cabinet door, most of which are metallic, allowing for the use of the built-in magnets for easy installation and convenient location. The jewelry storing device has a frame which is formed by two frame members, a front member and back member, which snap together to attach and hold a mesh screen flat and taut. The screen provides a mesh-like grid which is intended for storing jewelry having hooks for attachment. In addition, double-sided hooks may be attached which can be used to store other items such as rings. Located below the screen on the front side of the holder there is an arrangement of adjacently positioned foam pads or pillows that are packed tightly together. The foam pads hold and display various items of jewelry such as rings, clip-on earrings, and rod and fastener earrings. The various jewelry items are held in place by inserting them between adjacent pads, similar to the manner in which various items of jewelry are held in a box or case upon purchase. Beneath the foam pads are several hooks that are built into the frame for hanging jewelry such as bracelets, short necklaces, watches, rings and earrings. Protruding outwardly on either side of the holder are circular posts with enlarged heads for storing longer necklaces.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 2:
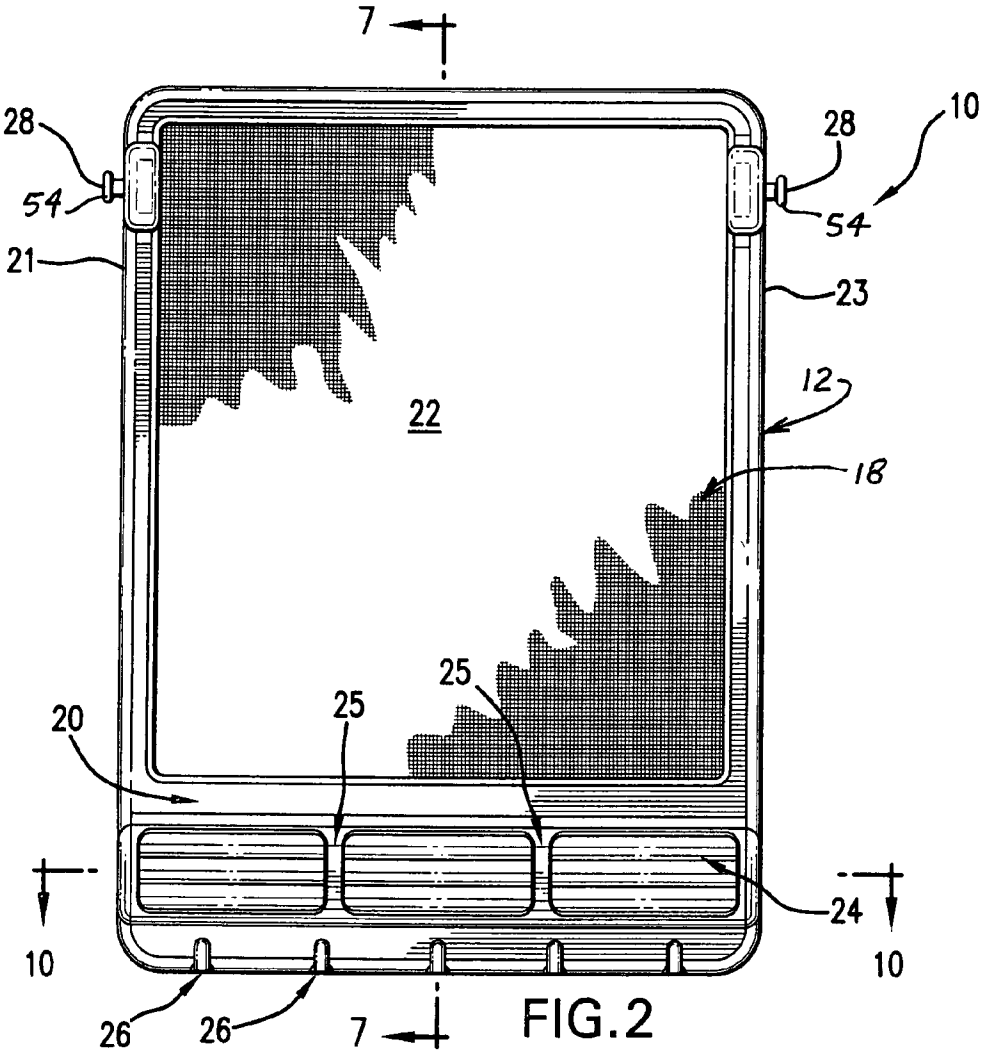
FIG. 2 is a front elevational view of the jewelry holder.

For purposes of description herein, the terms "upper," "lower," "left," "rear," "right," "front," "vertical," "horizontal," and derivates thereof shall relate to the invention as oriented in FIG. 2.

Figure 1:
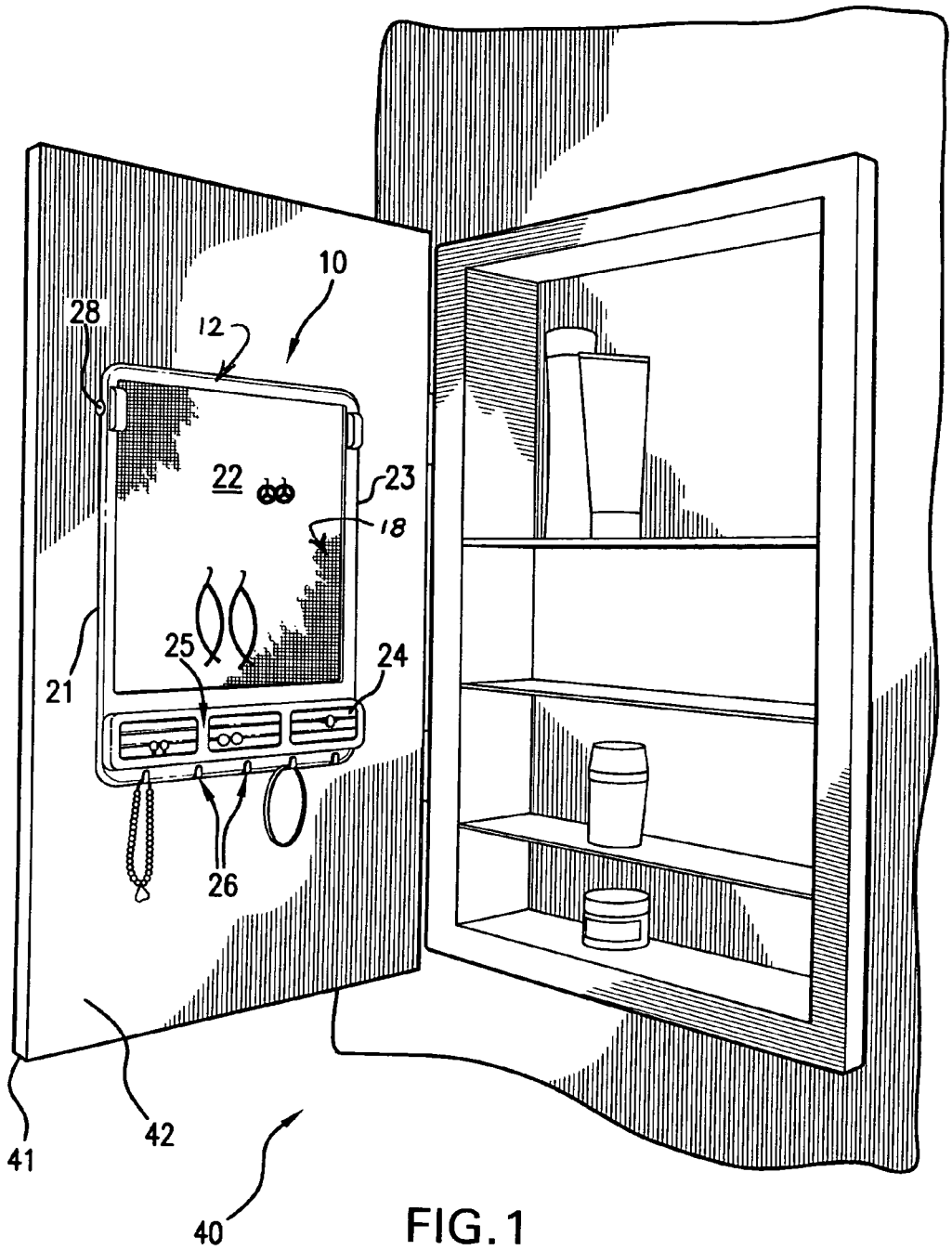
FIG. 1 is a perspective view of a preferred embodiment of the jewelry holder and organizer of the present invention shown mounted to the back side of a medicine cabinet door.

Turning to the drawings, FIG. 2 shows the jewelry holding apparatus 10 which includes a frame structure 12 having a front component 20 and a corresponding rear component 30. A front face 22 of mesh-style screen 18 is enclosed within a central area that is surrounded by the frame structure 12. Located beneath the front face 22 of the screen 18 are tightly packed foam pads (pillows) 24 which are held in place with bridges 25 integrally formed on the front component 20. Crevices between the tightly packed foam pads 24 allow for convenient insertion of jewelry items, such as post earring and rings which are held in place by the friction of adjacently positioned foam pads 24 (see FIGS. 1 and 9). Located beneath the tightly packed foam pads 24 are hooks 26 for holding jewelry such as bracelets, short necklaces, watches and earrings, as shown in FIG. 1. Hooks 26 are integrally formed on the front side 20 as a single molded piece. Hanging posts 28 with enlarged heads 54 are located on both the right side 23 and left side 21 of the holder 10. The enlarged heads help to prevent necklaces and bracelets from slipping off the posts 28.

Figure 3:
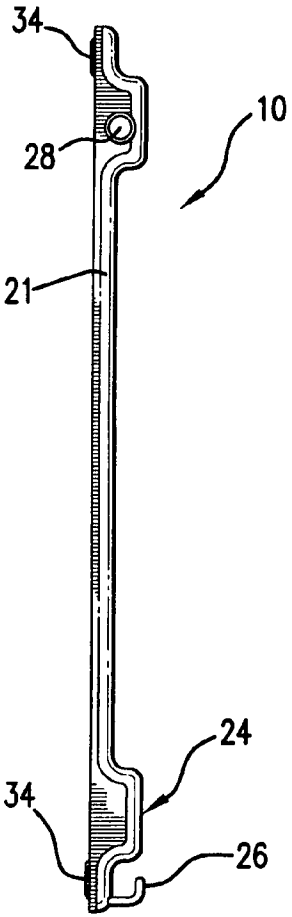
FIG. 3 is a side elevational view of the jewelry holder.

FIG. 3 illustrates a side elevational view of holder 10 showing left side 21 directly. Magnets 34 are shown within preformed pockets on the rear component 30 of the frame structure 12. This allows for easy and convenient mounting of the jewelry holder 10 to a metal or magnetically attractive surface. In particular, the jewelry holder 10 is ideally suited for mounting to the back side (inside) surface 42 of a door 41 on a medicine cabinet 40, as shown in FIG. 1.

Figures 4, 5, 6:
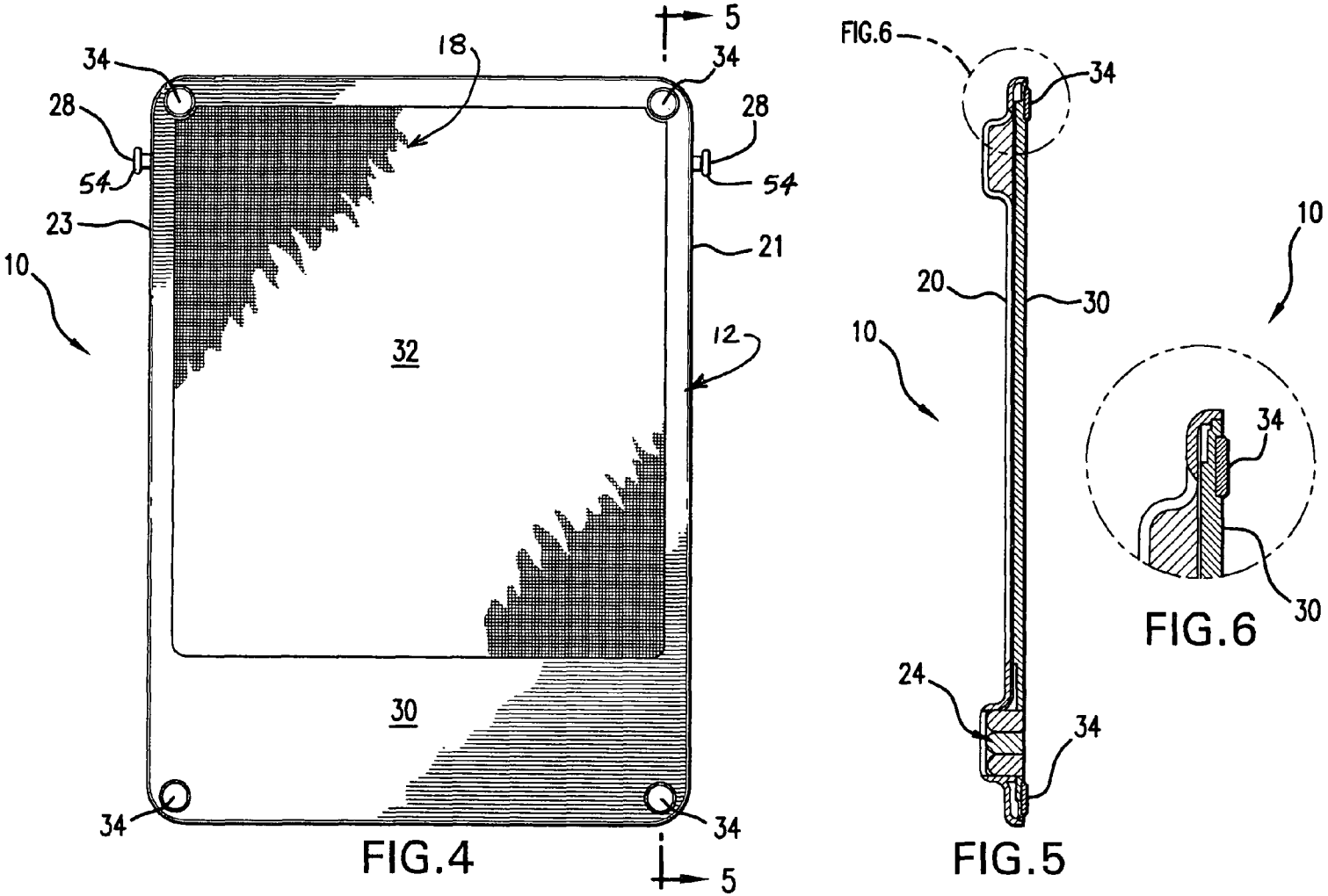
FIG. 4 is a rear elevational view of the jewelry holder.
FIG. 5 is a cross-sectional view of the jewelry holder taken along 5-5 in FIG. 4.
FIG. 6 is an isolated enlarged view taken from the encircled area indicated as "FIG. 6" in FIG. 5.

FIG. 4 shows a rear elevational view of holder 10 which illustrates the rear component 30 and the back side 32 of the screen 18 pulled taut and surrounded by the rear component 30 of the frame structure 12. Magnets 34 are shown attached to the rear component 30, within the preformed pockets or recesses formed in the rear component.

Figure 9:
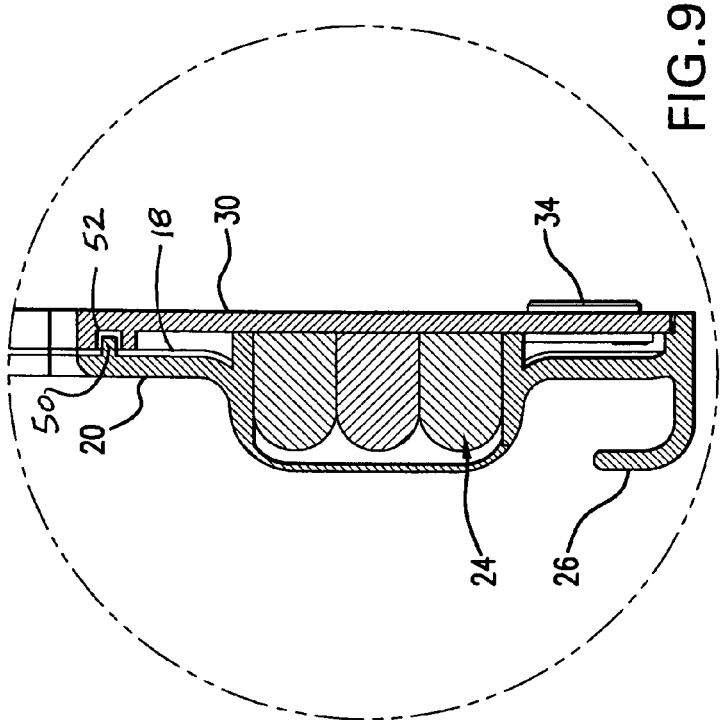
FIG. 9 is an isolated enlarged view of the encircled area indicated as "FIG. 9" in FIG. 7.
Figure 8:
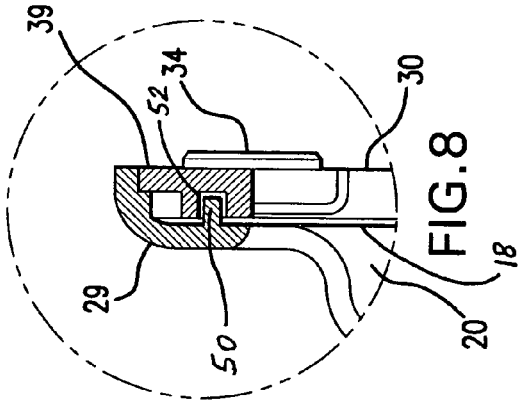
FIG. 8 is an isolated enlarged view of the encircled area indicated as "FIG. 8" in FIG. 7.
Figure 10:
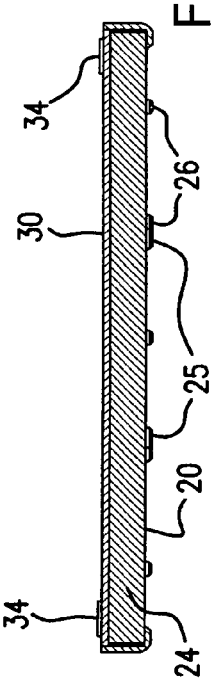
FIG. 10 is a cross sectional view of the holder taken along 10-10 in FIG. 2.
Figure 7:
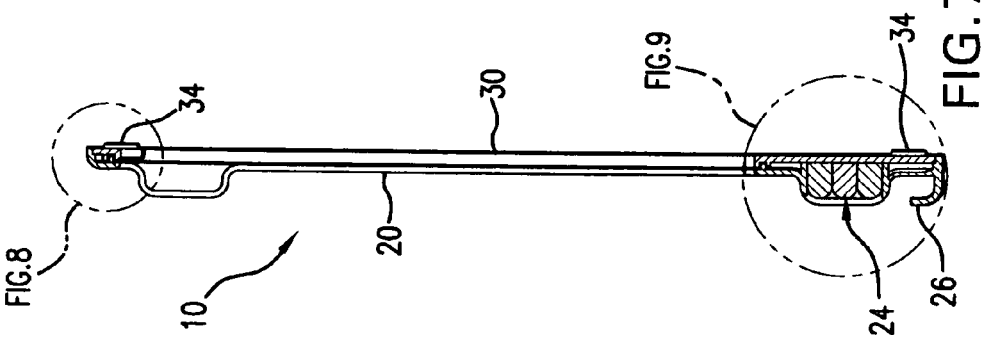
FIG. 7 is a cross sectional view of the holder taken along 7-7 in FIG. 2.

Referring to FIGS. 8 and 9, the front component 20 and rear component 30 of the frame structure have correspondingly positioned fastening members 29, 39 that surround the central area and mate together, when the front and rear components are attached, for holding the mesh screen 18 taut, flat and secure, with the screen 18 filling the central area. FIGS. 8 and 9 show fastening member 29 on the front component 20 and fastening member 39 on the rear component snapped together to provide the mechanism for attaching and holding screen 18 in place. Specifically, the tongue 50 of fastening member 29 fits into the groove 52 of the corresponding fastening member 39 to effectively anchor the peripheral edge of screen 18 in pinched relation between the tongue 50 and groove 52.

While the present invention has been shown in accordance with the preferred and practical embodiments, it is recognized that departures from the instant disclosure are fully contemplated within the spirit and scope of the present invention.

What is claimed is:

1. A device for holding and displaying various items of jewelry, said device comprising:

a frame structure including a front side having a front face and a rear side having a rear face, and said frame structure surrounding a central area, and said frame structure including a front component and a corresponding rear component that attaches to said front component;

a mesh screen fitted to said frame structure and held taut and flat to fill said central area, and said mesh screen being structured and disposed for removably holding at least some of the items of jewelry thereon;

said front and rear components of said frame structure including correspondingly positioned fastening members surrounding the central area for securing said mesh screen to said frame structure and for holding said mesh screen taut and flat and said correspondingly positioned fastening members being structured to be snapped together, and a first one of said corresponding fastening members including a tongue and a second one of said corresponding fastening members including a groove for receipt of said tongue therein to anchor said mesh screen in pinched relation therebetween;

a plurality of elongate pillow members extending horizontally and packed tightly together in a vertically stacked arrangement on said frame structure and being structured and disposed for removably holding at least some of the items of jewelry pinched between the plurality of elongate pillow members with a portion of the items of jewelry positioned and displayed for viewing on the front face of the front side of said frame structure;

a plurality of bridges integrally formed on said front side of said frame structure for holding said plurality of elongate pillow members tightly packed together;

a plurality of hooks on said frame structure for removably holding at least some of the items of jewelry; and at least one magnet within a preformed recess on the rear face of the rear side of said frame structure for mounting the device on a magnetically attractive surface.

2. The device as recited in claim 1 further comprising:

at least one post member extending from said frame structure, and said at least one post member being structured and disposed for hanging at least one of the items of jewelry thereon.

3. The device as recited in claim 2 wherein said at least one post member has an enlarged head for preventing the at least one item of jewelry hanging thereon from slipping off said at least one post member.

* * * * *